US008076857B2

(12) United States Patent
Young

(10) Patent No.: US 8,076,857 B2
(45) Date of Patent: Dec. 13, 2011

(54) DISPLAY DEVICES WITH AMBIENT LIGHT SENSING

(75) Inventor: Nigel David Young, Surrey (GB)

(73) Assignee: Chimei Innolux Corporation, Miao-Li County (TW)

( * ) Notice: Subject to any disclaimer, the term of this patent is extended or adjusted under 35 U.S.C. 154(b) by 642 days.

(21) Appl. No.: 12/236,951

(22) Filed: Sep. 24, 2008

(65) Prior Publication Data

US 2009/0085485 A1 Apr. 2, 2009

Related U.S. Application Data

(60) Provisional application No. 60/975,521, filed on Sep. 27, 2007.

(30) Foreign Application Priority Data

Mar. 3, 2008 (EP) ..... 08152219

(51) Int. Cl.
*H05B 37/02* (2006.01)

(52) U.S. Cl. ..... 315/149; 315/308

(58) Field of Classification Search ..... 349/62; 362/97.1, 97.2, 97.3; 345/102; 315/291, 315/307, 308, 149

See application file for complete search history.

(56) References Cited

U.S. PATENT DOCUMENTS

| | | | | |
|---|---|---|---|---|
| 6,762,741 | B2 * | 7/2004 | Weindorf | 345/102 |
| 7,236,154 | B1 * | 6/2007 | Kerr et al. | 345/102 |
| 2002/0158883 | A1 | 10/2002 | Cheri et al. | |
| 2005/0067553 | A1 | 3/2005 | Agari et al. | |
| 2005/0140641 | A1 * | 6/2005 | Kim et al. | 345/102 |
| 2005/0151716 | A1 * | 7/2005 | Lin | 345/102 |
| 2008/0136336 | A1 * | 6/2008 | Kalnitsky et al. | 315/158 |
| 2008/0165116 | A1 * | 7/2008 | Herz et al. | 345/102 |

FOREIGN PATENT DOCUMENTS

| | | | |
|---|---|---|---|
| GB | 2403096 | A | 12/2004 |
| JP | 2005121997 | A | 5/2005 |

* cited by examiner

*Primary Examiner* — Thuy Vinh Tran

(74) *Attorney, Agent, or Firm* — Morris Manning & Martin LLP; Tim Tingkang Xia, Esq.

(57) ABSTRACT

A display device comprises an illumination source (12), a display modulator (10) for modulating the light provided by the illumination source and an integrated light sensor arrangement (14) to detect a light level. Light sensor signals from a plurality of light sensors are processed such that localized shielding of the ambient light at the location of one or more of the light sensors is identified. An accurate estimate of the ambient light level can then be obtained.

15 Claims, 2 Drawing Sheets

DISPLAY DEVICES WITH AMBIENT LIGHT SENSING

This invention relates to display devices, for example display devices using illumination light sources, with the display device modulating the light from the illumination light source.

A liquid crystal display is the most common example of this type of modulating display device, and typically comprises an active plate and a passive plate between which liquid crystal material is sandwiched. The active plate comprises an array of transistor switching devices, typically with one transistor associated with each pixel of the display. Each pixel is also associated with a pixel electrode on the active plate to which a signal is applied for controlling the brightness of the individual pixel.

The level of ambient light has a strong influence on the performance of a display device which is used to modulate a light source. Similarly, the ambient light level influences the performance of a display formed of light emitting pixels, such as a LED display.

It has been recognised that the performance of displays can be improved by using information from light sensors (photodetectors) to modify the operation of the display. For example, the intensity of the backlight of the display may be adjusted in response to information from light sensors which are able to sense the characteristics of the ambient illumination, as a means of reducing the power consumption of the display when the ambient light levels are low, and to provide a good quality output when the ambient light levels are high. This can be used to assure that the display is lit to the optimum brightness at all times.

The required light sensors can be formed as part of the active plate of the display using thin film technology, and this is a convenient way of adding the light sensor capability without requiring additional process steps or separate components. The light sensitive devices may for example be thin film transistors, thin film diodes, lateral diodes or light sensitive resistors.

FIG. 1 which shows a display system having a display 10, a backlight 12, a light sensor 14 and control circuitry 16 for operating the display and the backlight. A signal is fed from the light sensor 14 to the controller 16 so that the controller can modify the operation of the display and the backlight in response to changes in the detected illumination.

There will be contributions to the output signal from the sensor 14 which result from the ambient light 18 at the front of the display and from the light 20 generated by the backlight 12.

FIG. 2 shows in a simplified form the way in which the light sensors can be integrated within the display. In this example, the display is formed from two glass substrates 24,26 with a liquid crystal layer 28 between them. The light sensor is arranged as an array of light sensor elements 30 which are fabricated on the lower substrate 26 which is closest to the backlight of the display. Ambient light from the front of the display is able to pass through the upper substrate 24 and the liquid crystal layer 28 to reach the light sensor 30.

The light sensor can be sensitive to light from both sides of the glass, or can be screened from light form one or both sides using metal (or other masks). In the example of FIG. 2, light from the backlight 34 is shown able to pass through the lower substrate 26 to reach the sensor. It is possible to block the direct path of light from the backlight to the light sensor, for example by providing an opaque layer at the base of the thin film layers defining the light sensor.

The light sensors can thus be used to measure the ambient light signal (or the ambient light plus top light for a top lit display), the backlight signal, or both signals together. A combination of different sensors can then be used to perform various subtractions and differential measurements. Furthermore, the light sensors can be used with colour filters to derive R, G and B signals which could also be used to change the hue of the image as the ambient light changes.

For completeness, FIG. 2 shows a light masking layer 36. The use of a black mask layer is well known to shield the areas of the active plate through which unmodulated light can pass, and to shield the transistors as their operating characteristics are light-dependent. The top and bottom polarizers 38, 40 are also shown. The black mask layer has an opening to allow ambient light to reach the sensors 30.

The light sensors (and their control circuitry) can be integrated onto the substrate (low temperature polysilicon LTPS or amorphous silicon aSi:H) which is used for the display backplane, thus reducing cost and complexity, and leading to a more compact solution. This is possible because the TFT and diode devices used in such displays are themselves photosensitive.

One of the problems with ambient light control is that the photodetector may be occluded, for example accidentally covered by a finger or shadowed by a hand, thus giving a false indication of ambient light.

According to the invention, there is provided a display device comprising:

an illumination source;

a display modulator for modulating the light provided by the illumination source;

a light sensor arrangement to detect a light level; and a processor for processing the signals received from the light sensor arrangement, wherein the light sensor arrangement comprise a plurality of light sensors with each of the plurality of light sensors exposed to ambient light, and wherein the processor is adapted to process the light sensor signals such that localised shielding of the ambient light at the location of one or more of the light sensors is identified, and to derive an estimate of the ambient light level.

This arrangement uses a plurality of light sensors in more than one location, and a processor (which can comprise a simple logical circuit) which derives an output signal dependant on the inputs form all of those sensors.

The processor can be adapted to compare the light sensor signals, and to disregard the signal from one or more light sensors if the signal is significantly lower than the signal from all other sensors. This enables light sensor signals to be disregarded when it is identified that they are covered or in a dark shadow. For example, a predetermined threshold can be used to analyse the signals, for example if one sensor has an output of less than 10% of the others.

The processor can be adapted to compare the light sensor signals, and to combine the signals from all light sensors if they are all close to each other. Thus, all sensor signals can be used to contribute to an average value if none are determined as shielded. Predetermined difference margins can be used to compare the signals.

The invention also provides a method of controlling an illumination source for a display device, the display device comprising a display modulator for modulating the light provided by the illumination source, the method comprising:

using a light sensor arrangement to detect a light level, the arrangement comprising a plurality of light sensors at spaced locations, with each of the plurality of light sensors exposed to ambient light, processing the detected light levels such that localised shielding of light is identified at the location of one or more of the light sensors, and to derive an estimate of the ambient light level; and controlling the display device using the ambient light level.

Controlling the display device can comprise controlling the illumination source.

An example of the invention will now be described in detail with reference to the accompanying drawings, in which.

The invention provides a display device in which signals from a plurality of light sensors are processed (each light sensor exposed to ambient light). Localised shielding of the ambient light at the location of one or more of the light sensors is identified, so that an accurate estimate of the ambient light level can be obtained.

Figure 1:
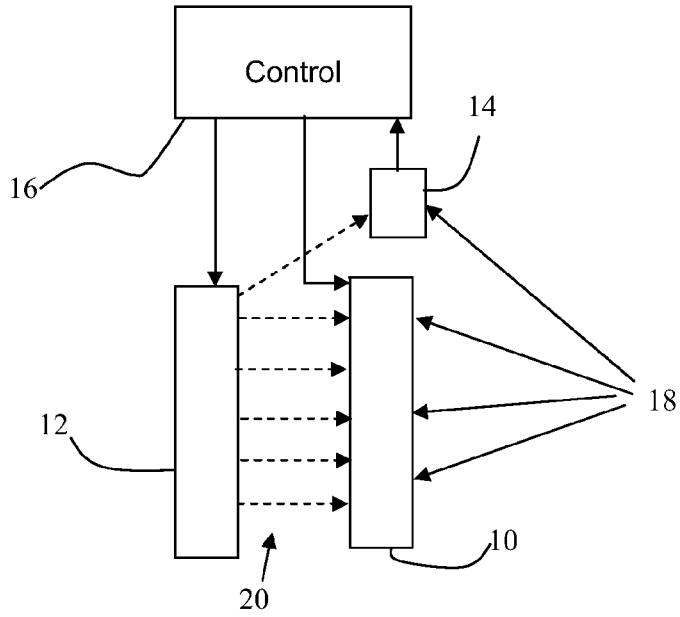
FIG. 1 (Prior Art)
FIG. 1 shows a known display using light sensing to control the backlight output level, and which can be modified and controlled to implement the method of the invention.
Figure 2:
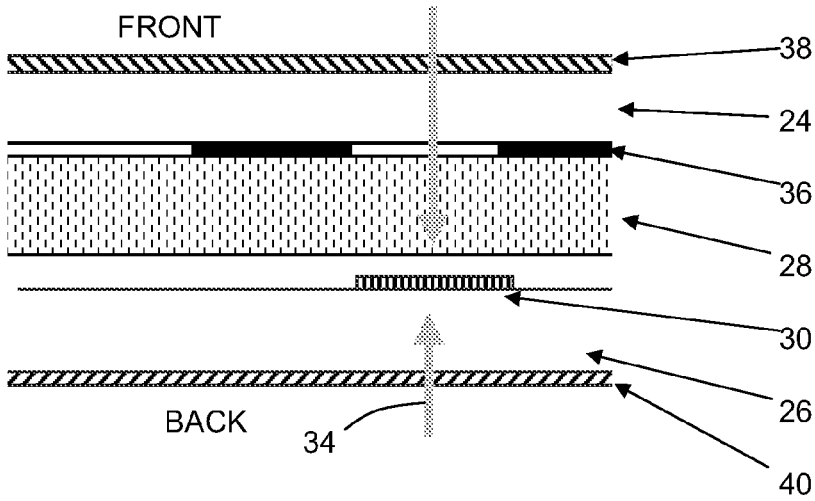
FIG. 2 (Prior Art)
FIG. 2 shows a cross section through a known active matrix liquid crystal display using integrated light sensors, and which can be used in a display device of the invention.

The display device and method of the invention can use the known configurations shown in FIGS. 1 and 2.

Figure 3:
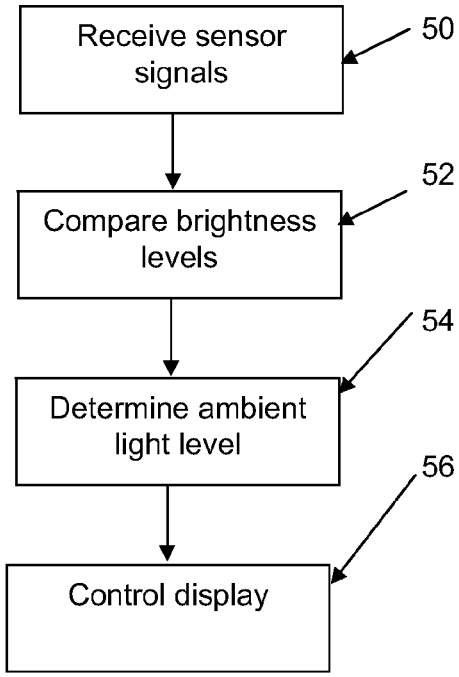
FIG. 3 is used to explain an example of control method of the invention.

FIG. 3 shows an implementation of the method of the invention.

In step 50, light sensor signals from a plurality of integrated light sensors are obtained.

In step 52, the light sensor levels are compared. This is carried out to enable localised shielding of light at the location of one or more of the light sensors to be detected.

For example, if the signal from one or more light sensors is significantly lower than the signal from all other sensors then it can be assumed that there is a local obstruction or shadowing, so that the light sensor signal should be disregarded. A predetermined threshold can be used to determine that a light sensor signal should be disregarded, for example:

any light sensor having a signal less than 50% of the brightest light sensor signal (or less than 40%, 30%, 20% or 10% by way of example), or any light sensor having a signal less than 50% of the average light sensor signal (or less than 40%, 30%, 20% or 10% by way of example).

If there are no such signals to be disregarded, so that all light sensor signals can be considered to be close to each other, then the signals from all light sensors can be combined, for example an average can be taken. In this case, all sensor signals will be within predetermined difference margins.

Many different algorithms can be employed to enable occluded sensors to be taken out of the determination of the ambient light level.

If the number of sensors is small (for example 4) then simple approaches can be taken, such as finding the smallest signal and simply discarding it from the average. This would work if there are no sensors occluded, or if there is only one sensor concluded. This is by far the most likely scenario.

Alternatively, the median value of the sensor signals could be taken. For an odd number of sensors, this can give an appropriate value. For an even number of sensors, the highest reading from the two sensors either side of the median could be taken. An alternative approach is to find the median and then average all sensors with an output above the median.

In step 56, the display device is controlled using the ambient light level as a control parameter. In the example of a backlit LCD display, this control involves controlling the backlight illumination source.

The light sensor signals may be used to derive information in addition to the ambient light level, for example they may also be used to derive information about the backlight output level, as an additional feedback parameter.

In order to implement the ambient light sensing and ambient light level determination, the following steps can be carried out:

(i) The sensor photocurrents are converted into voltages.

(ii) The voltages are digitised. This digitisation can be carried out in a multiplexed way to reduce the number of converters.

(iii) Once in the digital domain, any algorithm can be implemented on or off the glass substrate.

In one preferred implementation, the sensors and display pixel circuitry are formed in low temperature polysilicon, and the display driver control circuitry and/or the current-voltage conversion circuitry, A/D conversion circuitry and processing capability to perform the ambient light level calculations can also be integrated on the same substrate.

Figure 4:
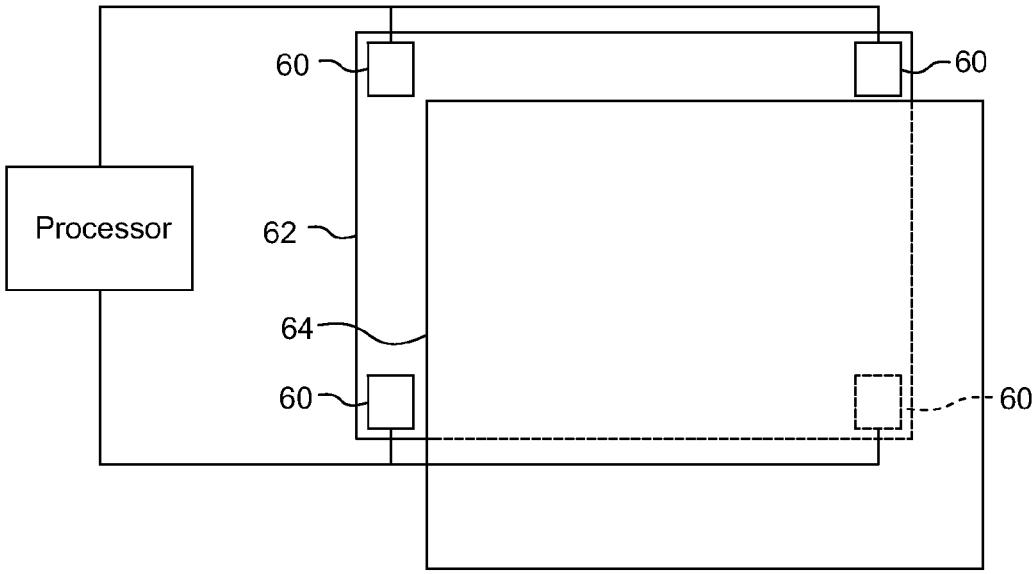
FIG. 4 shows a display device of the invention.

FIG. 4 shows one example of display device of the invention, in which there are four light sensors 60, one on each corner of the display substrate 62. The front surface is shown schematically as 64.

The approach of the invention can be extended to correct for shadows across the display, by adjusting the display output locally to compensate for shadows across that region of the display. For example, a larger matrix (e.g. 10×10) of sensors can give local brightness measurements, and compensations can be fed into the image either by varying the data values (through image processing) or by adjusting the power to individual blocks of a segmented backlight (or LED pixel power for an LED display). Again, using the approach of the invention, sensor signals which give very different light levels can be disregarded, as this can be assumed to result from sensor obstruction rather than shadowing. Thus, different thresholds may applied to differentiate between shadow areas and more occluded light sensors.

The obtained information concerning ambient light levels can be used in known manner to adjust the backlight (or other light source) output to implement power savings in dark ambient light conditions and to ensure good image visibility in bright ambient light conditions.

The integrated light sensors can comprise thin film devices formed using the same thin film layers used to form a display pixel array, and the light sensor may be arranged as an array of light sensor elements as mentioned above. At the limit, there may be one light sensor element integrated into each display pixel.

The invention can be used to implement ambient light sensors in LCD or other light modulating displays with rear or front illumination. It can also be used in displays having light generating pixels, such as LED displays, and in this case the control implemented is control of the pixel output levels. In the case of a display with light emitting pixels, the pixels themselves function both as an illumination source and a display modulator for modulating the light provided by the illumination source. The description and claims should be understood accordingly, and it will thus be apparent that the light modulator and illumination source do not need to be separate components, as they are in the LCD example given above.

In the example above, the determined ambient light level is used to control the brightness of the display, but it might instead or additionally be used to control other aspects of the display operation, for example changing the contrast or gamma settings of the display, or the refresh frequency.

One way of performing the required calculations is by analogue or digital circuits, which are preferably integrated onto the display substrate. However, a computer program running on a processor could also be used.

The light sensor signals can be taken with a sampling period depending on the desired use of the information. For shadow correction, relatively frequent updating may be required, whereas for general power saving purposes, less frequent update may be needed.

When used for backlight control, it is known that the brightness of the backlight can be changed by adjusting the pulse width or pulse frequency for a given pulse width of a pulsed illumination source output.

When used for pixel output control (for example an LED display), the power level to the LED pixels (rather than the backlight) can be controlled. Red, Green and Blue pixels with separate power supplies could be adjusted independently.

The light sensors are described above as at spaced apart locations. By this is meant that there are different light sensors which are sufficiently spaced that they may receive different light intensities as a result of shadowing or obstructions such as a hand or finger.

Various modifications will be apparent to those skilled in the art.

The invention claimed is:

1. A display device comprising:

an illumination source;

a display modulator for modulating the light provided by the illumination source;

a light sensor arrangement to detect a light level; and a processor for processing the signals received from the light sensor arrangement, wherein the light sensor arrangement comprises a plurality of light sensors at spaced locations, with each of the plurality of light sensors exposed to ambient light, and wherein the processor is configured to process the light sensor signals such that localised shielding of the ambient light at the location of one or more of the light sensors is identified, and to derive an estimate of the ambient light level.

2. A display device as claimed in claim 1, wherein the light sensors are integrated onto a display device substrate.

3. A display device as claimed in claim 1, wherein the processor is configured to compare the light sensor signals, and to disregard the signal from one or more light sensors if the signal is significantly lower than the signal from all other sensors.

4. A display device as claimed in claim 3, wherein the processor is configured to disregard the signal from one or more light sensors if the signal is more than a predetermined threshold lower than the signal from all other sensors.

5. A display device as claimed in claim 1, wherein the processor is configured to compare the light sensor signals, and to combine the signals from all light sensors if they are all close to each other.

6. A display device as claimed in claim 5, wherein the combining comprises an averaging.

7. A display device as claimed in claim 5, wherein the signals from all light sensors are considered close to each other if they are within predetermined difference margins.

8. A display device as claimed in claim 1, wherein the processor is implemented as a logic circuit which is integrated onto a display device substrate.

9. A method of controlling an illumination source for a display device, the display device comprising a display modulator for modulating the light provided by the illumination source, the method comprising:

using a light sensor arrangement to detect a light level, the arrangement comprising a plurality of light sensors at spaced locations, with each of the plurality of light sensors exposed to ambient light;

processing the detected light levels such that localised shielding of light is identified at the location of one or more of the light sensors, and to derive an estimate of the ambient light level; and controlling the display device using the ambient light level.

10. A method as claimed in claim 9, wherein controlling the display device comprises controlling the illumination source.

11. A method as claimed in claim 9, wherein the processing comprises comparing the light sensor signals, and disregarding the signal from one or more light sensors if the signal is significantly lower than the signal from all other sensors.

12. A method as claimed in claim 11, wherein the processing comprises disregarding the signal from one or more light sensors if the signal is more than a predetermined threshold lower than the signal from all other sensors.

13. A method as claimed in claim 9, wherein the processing comprises comparing the light sensor signals, and combining the signals from all light sensors if they are all close to each other.

14. A method as claimed in claim 13, wherein the combining comprises an averaging.

15. A method as claimed in claim 13, wherein the signals from all light sensors are considered close to each other if they are within predetermined difference margins.

* * * * *